US008636531B2

(12) United States Patent
Sasaki et al.

(10) Patent No.: US 8,636,531 B2
(45) Date of Patent: Jan. 28, 2014

(54) CONNECTOR FOR CONNECTION WITH FLAT CONNECTING OBJECTS

(75) Inventors: Daisuke Sasaki, Yao (JP); Takayuki Nagata, Yao (JP)

(73) Assignee: Hosiden Corporation, Yao-shi (JP)

( * ) Notice: Subject to any disclaimer, the term of this patent is extended or adjusted under 35 U.S.C. 154(b) by 0 days.

(21) Appl. No.: 13/488,588

(22) Filed: Jun. 5, 2012

(65) Prior Publication Data

US 2013/0023142 A1 Jan. 24, 2013

(30) Foreign Application Priority Data

Jul. 22, 2011 (JP) ..... 2011-161257

(51) Int. Cl.
*H01R 11/22* (2006.01)

(52) U.S. Cl.
USPC ..... 439/260

(58) Field of Classification Search
USPC ..... 439/260, 267, 633, 637, 161, 495
See application file for complete search history.

(56) References Cited

U.S. PATENT DOCUMENTS 7,147,498 B1 12/2006 Gillespie et al.
2008/0096431 A1 4/2008 Chen et al.
2008/0176424 A1 7/2008 Wu
2010/0304594 A1* 12/2010 Yokoo et al. ..... 439/325
2013/0023138 A1* 1/2013 Sasaki et al. ..... 439/260

FOREIGN PATENT DOCUMENTS

EP 1 976 068 A2 10/2008
JP 2005-353469 12/2005
JP 2009-64743 A1 3/2009

OTHER PUBLICATIONS

European Search Report for the counterpart European patent application No. 12250135.6, dated Oct. 11, 2012.

* cited by examiner

*Primary Examiner* — Neil Abrams
*Assistant Examiner* — Phuongchi T Nguyen
(74) *Attorney, Agent, or Firm* — Kratz, Quintos & Hanson, LLP

(57) ABSTRACT

The invention provides a connector including a housing, contacts, and an actuator. The housing includes a first depression and second depressions. The second depressions are provided at opposite edges of the first depression and each include a bottom surface forming a slope. The contacts are arranged at intervals in the housing and each include a hook to be disposed within the first depression. The actuator includes bosses and a shaft. The bosses are received in the second depressions. The shaft is received in the first depression. When the actuator is in an upright position, the bosses are on the slopes and the shaft is positioned on the other side of the hooks. When the actuator rotates from the upright position to a lying position, the bosses rotatingly move up along the slopes and the shaft thereby move to the one side to be engaged with the hooks.

11 Claims, 11 Drawing Sheets

CONNECTOR FOR CONNECTION WITH FLAT CONNECTING OBJECTS

The present application claims priority under 35 U.S.C. §119 of Japanese Patent Application No. 2011-161257 filed on Jul. 22, 2011, the disclosure of which is expressly incorporated by reference herein in its entity.

BACKGROUND OF THE INVENTION

1. Technical Field

The present invention relates to connectors for connection with flat connecting objects such as flexible printed circuits (FPCs) and flexible flat cables (FFCs).

2. Background Art

A conventional connector of this type is provided with a housing, a plurality of contacts, and an actuator. The housing includes a first depression, a pair of second depressions provided in lengthwise edges of the first depression, and a plurality of accommodating holes provided at intervals along a lengthwise direction and communicating with the first depression. The contacts are press-fitted into the respective accommodating holes and arranged at intervals in the lengthwise direction of the housing. The contacts each include a hook, which is positioned within the first depression, and a projection, which projects downward from the base of the hook. The actuator includes first and second ends in the widthwise direction, and third and fourth ends in the lengthwise direction. The first end is received in the first depression, and the third and fourth ends are received in the second depressions. The first end is provided with a plurality of shafts arranged at intervals in the lengthwise direction. The shafts of the actuator are engaged with the respective hooks of the contacts, so that the actuator is held so as to rotate between an upright position and a lying position. The actuator in the upright position is upright with respect to the housing, and the actuator in the lying position lies with respect to the housing. The second depressions have stepped bottom surfaces. The third and fourth ends have stepped contact surfaces conforming to the shapes of the bottom surfaces.

When the actuator is attached to the contacts, the contact surfaces of the third and fourth ends are brought into contact with the bottom surfaces of the second depressions of the housing. The contacts are then inserted into the accommodating holes. This brings the projections of the contacts into contact with the shafts of the actuator, and the shafts are positioned below the hooks of the contacts. The contacts are thereafter inserted further into (press-fitted into) the accommodating holes, and the shafts of the actuator are pressed against the projections of the contacts, so that the contact surfaces of the actuator climb up the steps on the bottom surfaces of the second depressions of the housing. This causes the shafts of the actuator to be engaged with the hooks of the contacts (see paragraphs 0036 to 0040, and FIG. 9 to FIG. 12 of Japanese Unexamined Patent Application Publication No. 2009-64743).

SUMMARY OF INVENTION

The above conventional connector is configured such that the projections of the contacts press the shafts of the actuator when the shafts are brought into engagement with the hooks of the contacts. As such, the contacts and the actuator take heavy loads.

The present invention is contrived in view of the above circumstances. The invention provides a connector capable of reducing load to be placed on contacts and an actuator when shafts of the actuator are engaged with hooks of the contacts.

The connector according to an aspect of the present invention includes a housing, a plurality of contacts, and an actuator. The housing has an insulation property and includes a first depression and a pair of second depressions. The pair of second depressions is provided at opposite edges in a first direction of the first depression and each includes a bottom surface forming a slope. The slope slopes up toward the one side in a second direction orthogonally intersecting with the first direction. The plurality of contacts is arranged at intervals along the first direction in the housing and each include a hook to be disposed within the first depression. The actuator is adapted to be held at least by the housing so as to rotate between a lying position and an upright position. The actuator in the lying position faces to one side in the second direction, and the actuator in the upright position facing one side in a third direction orthogonally intersecting with the first and the second directions. The actuator includes a main body, a pair of bosses, and a shaft. The pair of bosses project from respective opposite ends in the first direction of the main body to be received in the respective second depressions. The shaft is located between the bosses of the main body to be received in the first depression. When the actuator is in the upright position, the bosses are on the associated slopes of the second depressions, and the shaft is positioned on the other side in the third direction of the hooks. When the actuator rotates from the upright position to the lying position, the bosses rotatingly move up along the slopes of the second depressions, and the shaft thereby move to the one side in the third direction to be engaged with the hooks.

According to this aspect of the invention, when the actuator is in the upright position, the bosses of the actuator are positioned on the slopes of the second depressions of the housing, while the shaft of the actuator is positioned on the other side in the third direction of the hooks of the contacts. When the actuator turns from the upright position to the lying position and the bosses rotatingly move up along the associated slopes of the second depressions of the housing, the shaft moves to the one side in the third direction to be engaged with the hooks of the contacts. This configuration can reduce the load placed on the actuator and the contacts because the contacts do not press the shaft when the shaft of the actuator is brought into engagement with the hooks of the contacts. This configuration can also prevent the actuator from falling off from the housing to the one side in the third direction because the shaft is engaged with the hooks of the contacts from the one side in the third direction when the actuator is positioned in the lying position.

The contacts may each further include an sloped portion provided on the other side in the second direction of the hook. The sloped portion may include a portion on the other side in the third direction that slopes up to the one side in the second direction. The shaft of the actuator in the upright position may abut the sloped portion. When the bosses rotatingly move up along the slopes of the second depressions, the shaft may move up along the sloped portions to be engaged with the hooks.

According to this aspect of the invention, the shaft moves up along the sloped portion and are brought into engagement with the hook when the bosses rotatingly move up along the associated slopes of the second depressions, so that there is some load placed on the actuator and the contacts. However, this load relates only to the shaft moving up the sloped portions and is therefore relatively small compared to the load on the actuator and the contacts of the conventional connector having contacts that press the shaft of the actuator. Further, the shaft moves up along the sloped portions when the bosses move up the slopes of the second depressions, this aspect of the invention can also lessen the possibility of the bosses slipping on the slopes of the second depression or from moving toward the other side in the second direction.

The housing may further include a plurality of accommodating holes that may be arranged at intervals along the first direction and communicate with the first depression. The contacts may be received and held in the respective accommodating holes.

According to this aspect of the invention, when the actuator is in the upright position, the shaft of the actuator is positioned on the other side in the third direction of the hooks of the contacts. Accordingly, by placing the actuator in the upright position and then inserting the contacts into the accommodating holes, it is possible to prevent the hooks of the contacts from colliding with the shaft of the actuator. It is therefore possible to lessen the possibility of placing load on the hooks of the contacts and the shaft of the actuator when attaching the contacts into the housing.

It is preferable that the shaft of the actuator in the upright position be disposed such that an axial center of the shaft is shifted away from an axial center of the bosses toward a bottom of the first depression of the housing.

According to this aspect of the invention, the actuator in the upright position is configured such that the axial center of the shaft is shifted from the axial center of the bosses to the bottom side of the first depression of the housing. This configuration can increase the moving distance of the shaft to the one direction in the third direction when the actuator turns from the upright position to the lying position and the bosses rotatingly move up along the slopes of the second depressions. The increased moving distance enables it to displace the shaft of the actuator in the upright position to a large degree away from the hooks to the other side in the third direction. Consequently, it is possible to prevent the hooks of the contacts from colliding with the shaft of the actuator during the insertion of the contacts into the accommodating holes.

The second depressions may each further include a wall on the one side in the second direction. The bosses of the actuator in the lying position may abut the slopes and the walls of the second depressions, while the shaft may be engaged with the hooks and abut the sloped portions.

According to this aspect of the invention, the bosses abut the slopes and the walls of the second depressions when the actuator is in the lying position, thereby restricting the movement of the actuator to the other side in the third direction and the one side in the second direction. On the other hand, the shaft is engaged with the hooks to abut the sloped portions, thereby restricting the movement of the actuator to the one side in the third direction and the other side in the second direction. In short, the movement of the actuator is restricted in four directions, thereby lessening the possibility of the actuator in the lying position falling off from the housing.

The shaft may be configured in a teardrop shape including a cylindrical portion and a triangular prismatic portion continuously connected to the cylindrical portion. When the actuator is in the upright position, the cylindrical portion of the shaft may abut lower areas of the sloped portions, while the triangular prismatic portion of the shaft may be directed to the other side in the third direction. When the bosses rotatingly move up along the slopes of the second depressions, the cylindrical portion may move up along the sloped portions to be engaged with the hooks, while the triangular prismatic portion may rotate toward the sloped portions. When the cylindrical portion is engaged with the hooks, the triangular prismatic portion may abut the sloped portions.

According to this aspect of the invention, when the cylindrical portion of the shaft is engaged with the hooks, the triangular prismatic portion of the shaft abuts the sloped portions. Therefore, the actuator is less likely to tilt beyond the lying position.

The connector of the invention may further include a ground contact provided in the housing. The ground contact may include a contact portion disposed within the first depression.

According to this aspect of the invention, when a connecting object is inserted into the first depression of the housing, the contact portion of the ground contact is brought into contact with the ground of the connecting object. It is thus possible to shield the connector and therefore improve the connector in terms of electromagnetic interference (EMI) characteristics or the like.

The ground contact may include a contact body including the contact portion, an abutting portion continuously connected to the contact body and abutting an outer surface of the housing, and a connecting portion provided at the abutting portion.

According to this aspect of the invention, the outer surface of the housing is in abutment with the abutting portion of the ground contact, which is provided with the connecting portion. The connecting portion provided outside the housing is easy to connect to a ground of a circuit board.

The abutting portion may be generally of an L shape and include a first plate and a second plate. The second plate may extend substantially at a right angle to the first plate. The first and the second plates may each be provided with the connecting portion.

According to this aspect of the invention, the first and second plates of the substantially L-shaped abutting portion are each provided with the connecting portion. The connector therefore has an improved mounting strength with respect to the circuit board by soldering the connecting portions to the ground of the circuit board.

DESCRIPTION OF EMBODIMENTS

The following describes a connector according to a first embodiment of the present invention with reference to FIG. 1A to FIG. 6C.

Embodiment 1

Figure 1A:
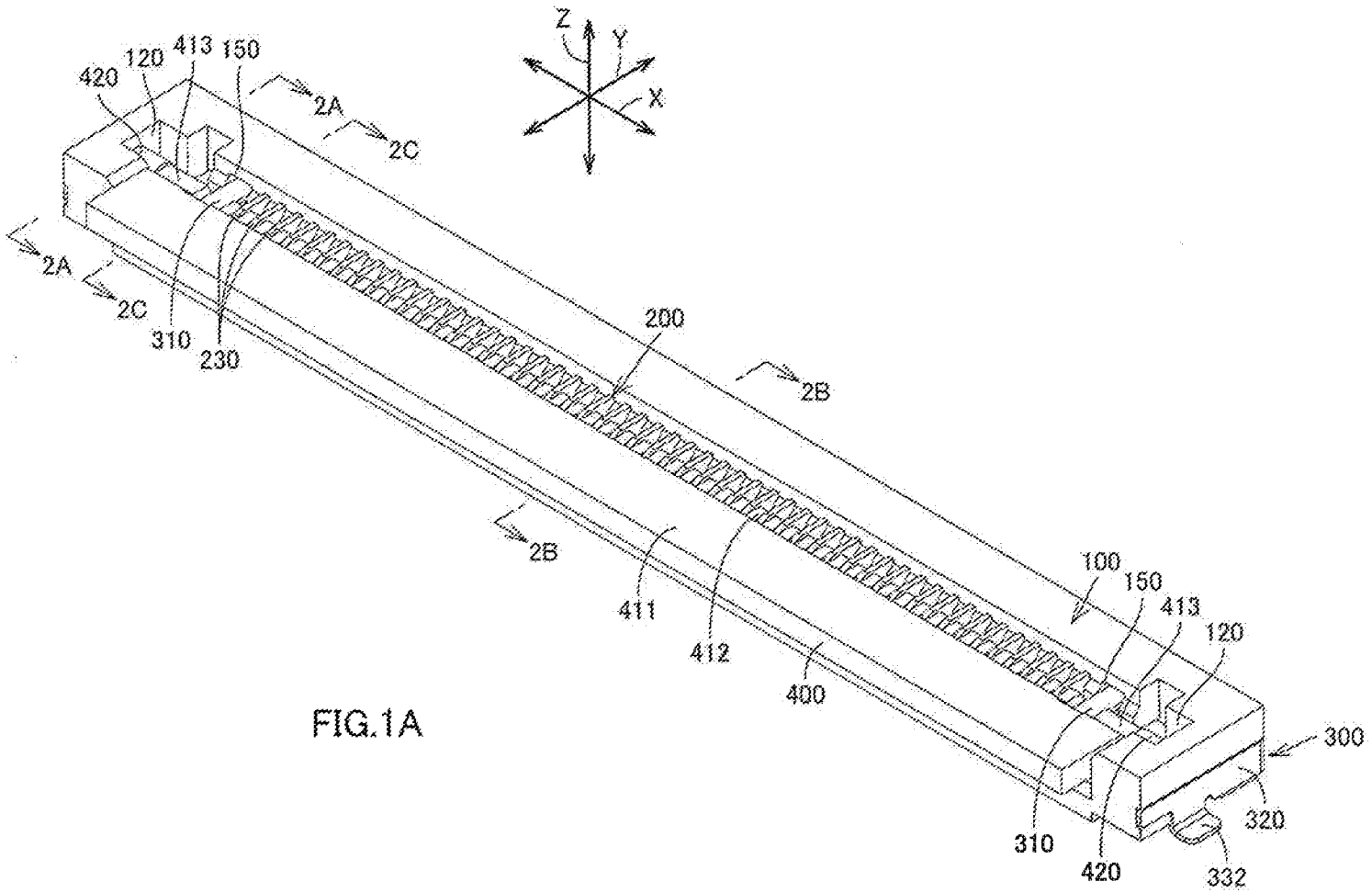
FIG. 1A is a schematic illustration of a front top right perspective view of a connector according to an embodiment 1 of the present invention.
Figure 1B:
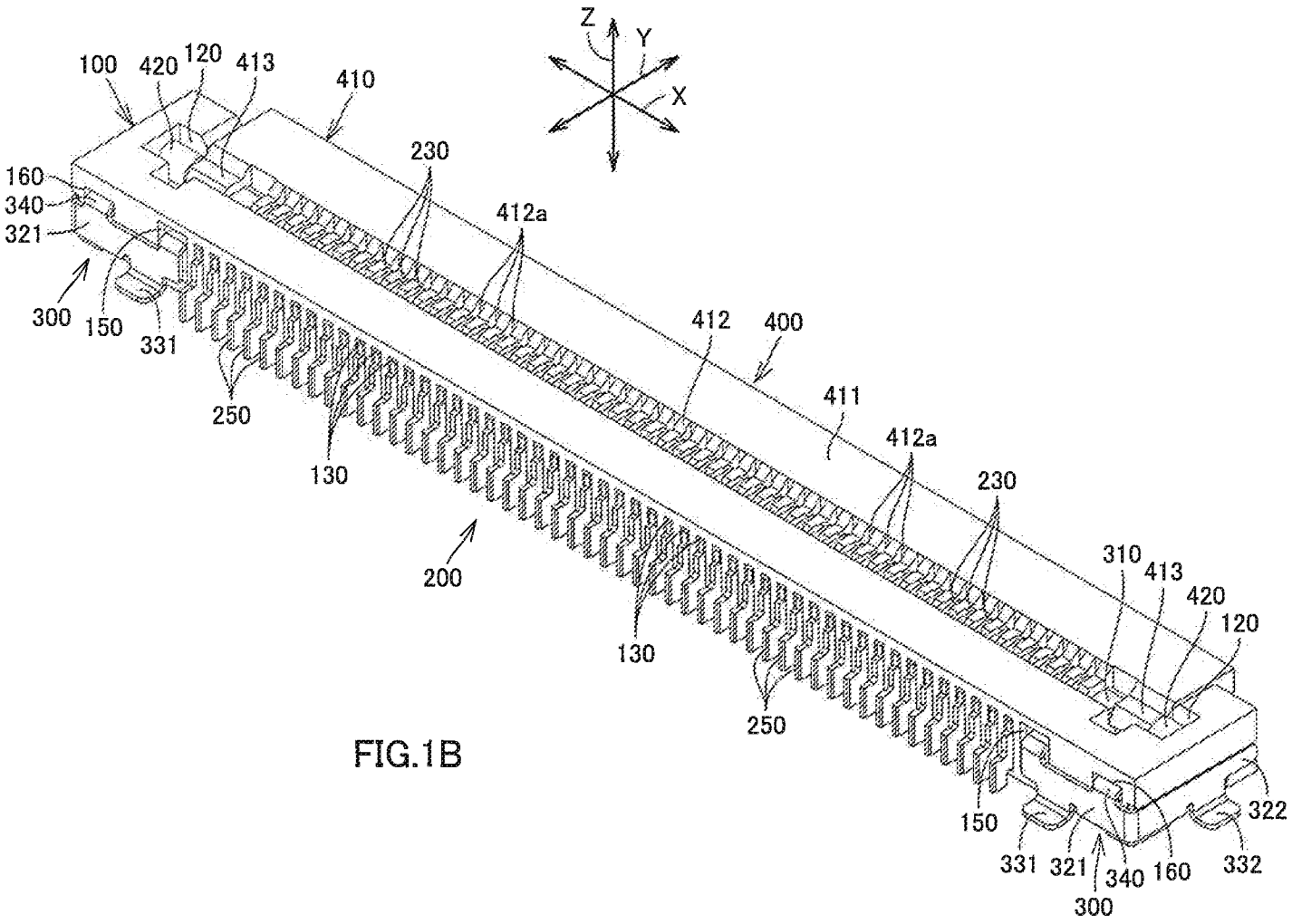
FIG. 1B is a schematic illustration of a back top left perspective view of the connector.

A connector illustrated in FIG. 1A and FIG. 1B is a receptacle connector that is mountable on a circuit board (not depicted) and connectable with a flexible printed circuit (FPC) 10 (see FIG. 5A to FIG. 6C). The connector includes a housing 100, a plurality of contacts 200, a pair of ground contacts 300, and an actuator 400. Each of these components of the connector will be described in detail below. For the convenience of description, FIG. 1A to FIG. 2E indicate a lengthwise direction of the connector as a first direction X, a front-back direction of the connector as a second direction Y, and a heightwise direction of the connector as a third direction Z. The second direction Y is an orthogonal direction with respect to the first direction X, and the third direction Z is an orthogonal direction with respect to the first direction X and the second direction Y.

Figure 2A:
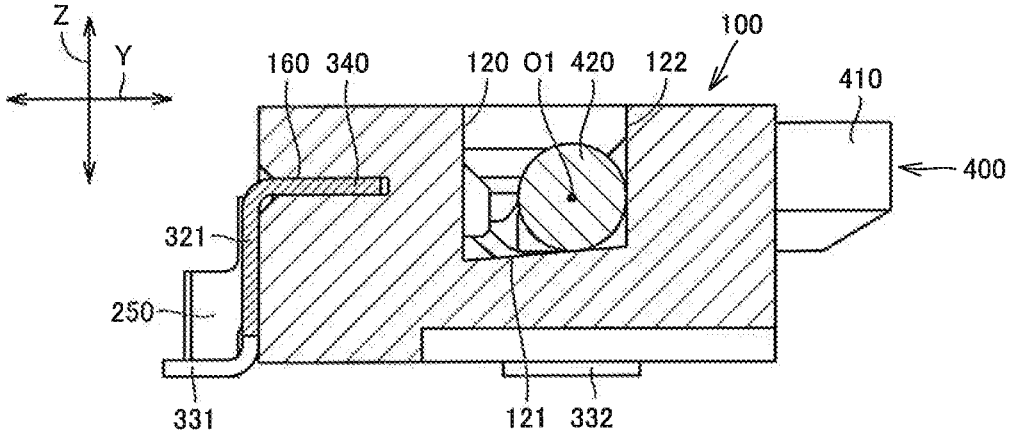
FIG. 2A is a cross-sectional view of the connector taken along line 2A-2A in FIG. 1A illustrating an actuator of the connector in a lying position.

As illustrated in FIG. 2A to FIG. 3B, the housing 100 is made of insulating resin and of a rectangular parallelepiped shape extending in the first direction X. The housing 100 is provided with a generally rectangular first depression 110 extending in the first direction X. The first depression 110 is open to one side in the second direction Y (front side) and to one side in the third direction Z (top side). On opposite edges in the first direction X of the first depression 110 of the housing 100, there is a pair of rectangular second depressions 120 that are open to the one side in the third direction Z. Each of the second depressions 120 includes a slope 121 and a wall 122. As illustrated in FIG. 2A, the slope 121 is a bottom surface of the second depression 120, sloping upward toward the one side in the second direction Y. The wall 122 is an internal wall of the second depression 120 on the one side in the second direction Y.

Figure 2B:
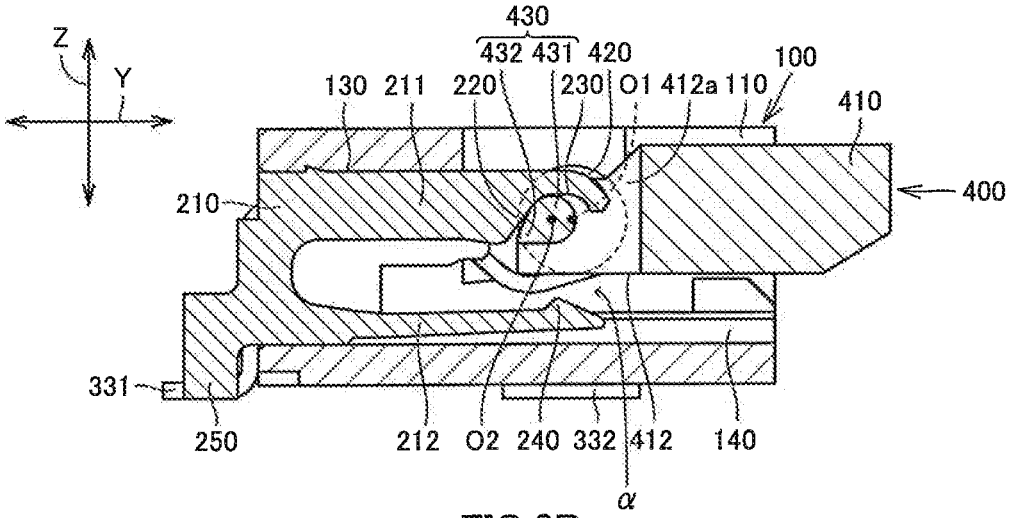
FIG. 2B is a cross-sectional view of the connector taken along line 2B-2B in FIG. 1A illustrating the actuator of the connector in the lying position.
Figure 3A:
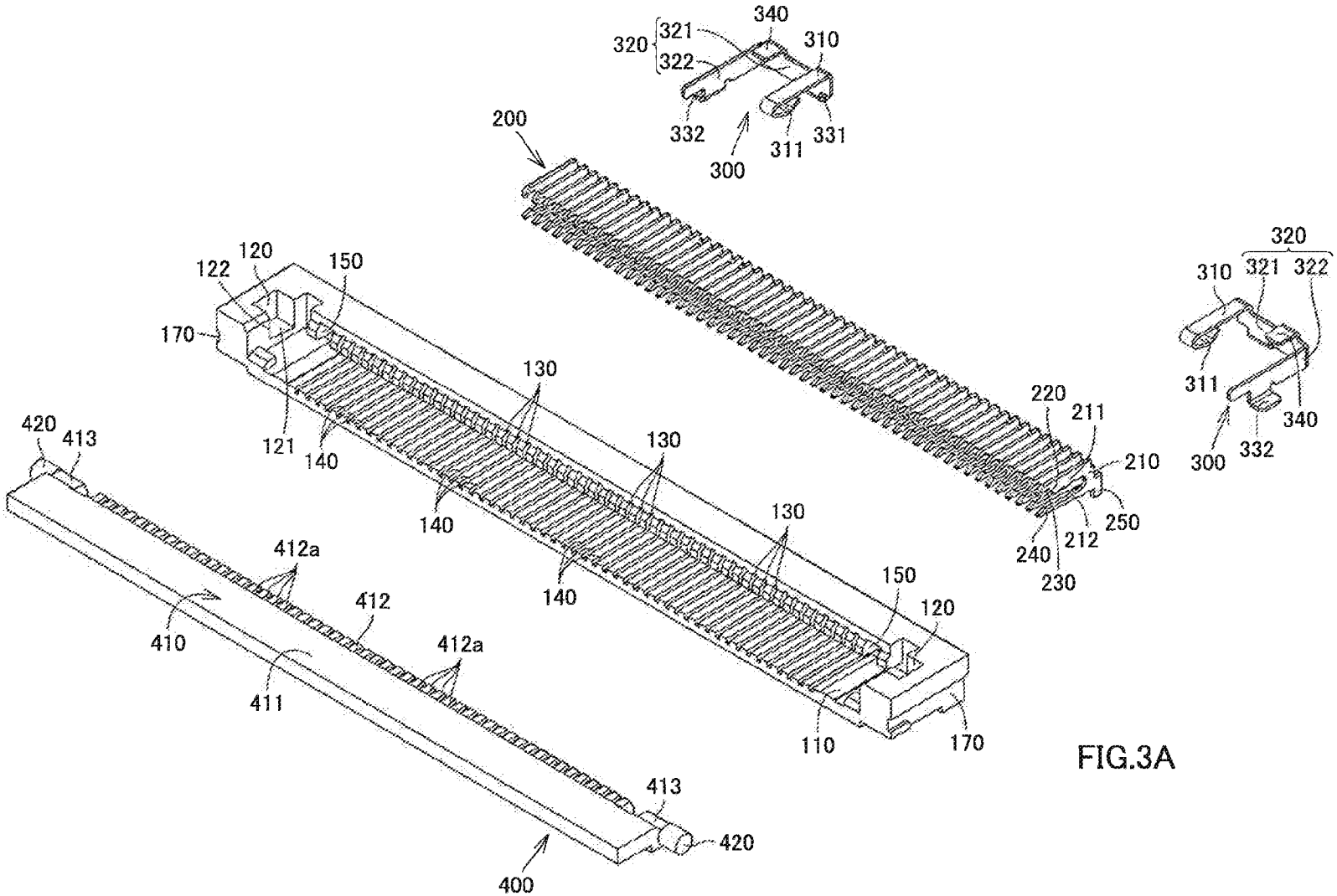
FIG. 3A is an exploded illustration of a front top right perspective view of the connector.
Figure 3B:
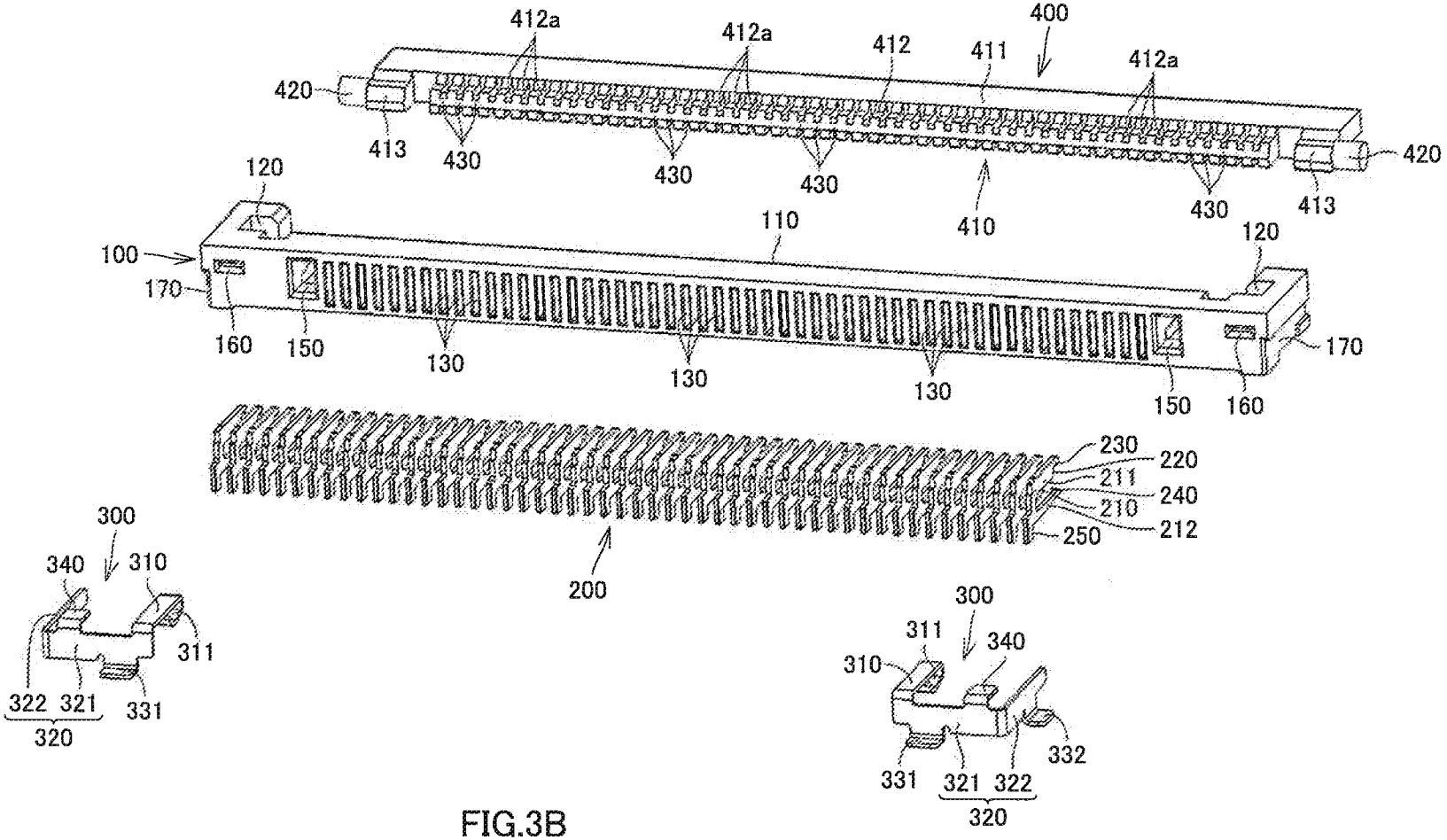
FIG. 3B is an exploded illustration of a back bottom left perspective view of the connector.

The housing 100 has a plurality of accommodating holes 130 arranged at intervals in the first direction X. As illustrated in FIGS. 2B, 3A and 3B, the accommodating holes 130 pass from the other side in the second direction Y (back side) of the housing 100 to the wall on the other side in the second direction Y of the first depression 110, i.e. the accommodating holes 130 communicate with the first depression 110. As illustrated in FIG. 3A, the bottom of the first depression 110 is formed with a plurality of receiving grooves 140 that are arranged along the first direction X at the same intervals as the accommodating holes 130. The receiving grooves 140 communicate with the first depression 110 and the respective accommodating holes 130.

Figure 2C:
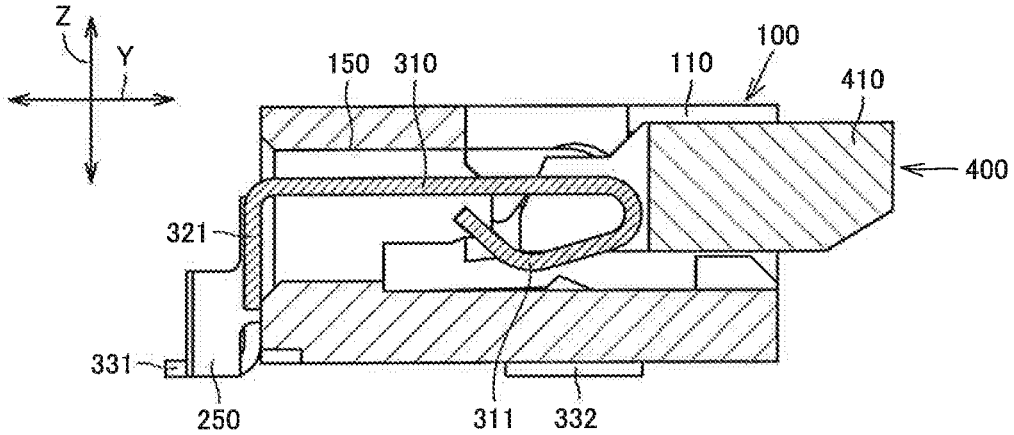
FIG. 2C is a cross-sectional view of the connector taken along line 2C-2C in FIG. 1A illustrating the actuator of the connector in the lying position.
Figure 2D:
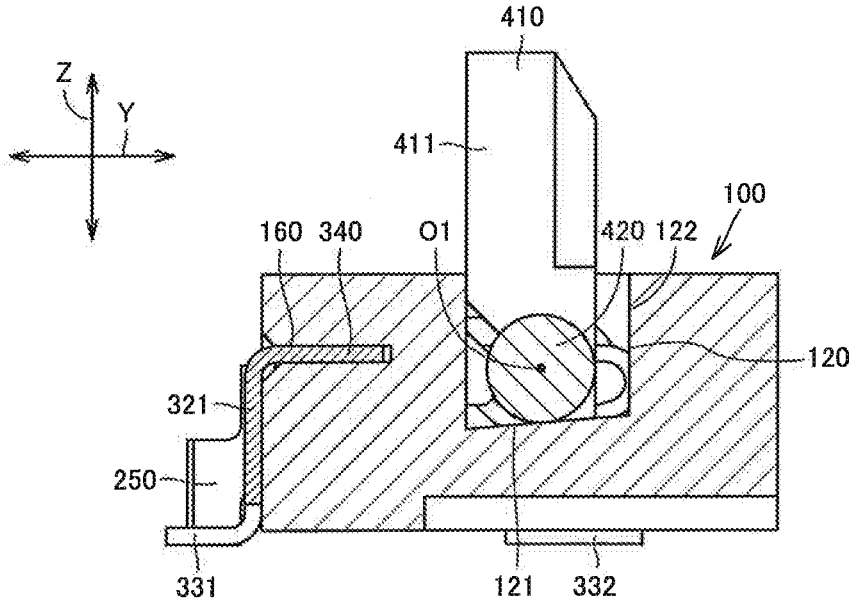
FIG. 2D is a cross-sectional view of the connector taken along line 2A-2A in FIG. 1A illustrating the actuator of the connector in an upright position.

The housing 100 has a pair of insertion holes 150 so as to sandwich the accommodating holes 130 therebetween in the first direction X. As illustrated in FIG. 2C, the insertion holes 150 pass from the other side in the second direction Y (back side) of the housing 100 to the wall on the other side in the second direction Y of the first depression 110. The insertion holes 150 communicate with the first depression 110. The housing 100 further has a pair of engagement holes 160 so as to sandwich the accommodating holes 130 and the insertion holes 150 therebetween in the first direction X. A pair of attachment depressions 170 is provided in opposite end faces in the first direction X of the housing 100.

As illustrated in FIG. 2B, the contacts 200 are electrically conductive metal plates to be received in the respective accommodating holes 130 of the housing 100. Each contact 200 includes an anchorable portion 210, a sloped portion 220, a hook 230, a contact portion 240, and a tail 250. The anchorable portion 210 is a generally C-shaped plate having a first arm 211 and a second arm 212, both extending toward the one side in the second direction Y. Projections are provided on opposite ends in the third direction Z of the anchorable portion 210. The dimension in the third direction Z of the anchorable portion 210 including the projections is slightly larger than the dimension in the third direction Z of each accommodating hole 130 of the housing 100. As such, the anchorable portions 210 are adapted to be press-fitted into the respective accommodating holes 130 of the housing 100. When the anchorable portions 210 are press-fitted in the accommodating holes 130 of the housing 100, tip ends of the first arms 211 are received in the first depression 110, and tip ends of the second arms 212 are received in the corresponding receiving grooves 140.

The hook 230 is provided at the tip end of the first arm 211. The hook 230 is depressed in a circular are shape on the other side in the third direction Z (lower side). The base of the hook 230 of the first arm 211 (the other side in the second direction Y of the hook) forms the sloped portion 220. When the anchorable portions 210 are press-fitted in the accommodating holes 130 of the housing 100, the hooks 230 and the sloped portions 220 are positioned within the first depression 110 of the housing 100. The sloped portion 220 is configured such that a portion on the other side in the third direction Z (lower side) slopes upward to the one side in the second direction Y. The inclination angle of the sloped portion 220 is configured so as to be larger than the inclination angle of each slope 121 of the second depression 120, and so as to allow shafts 430 of the actuator 400 (to be described) to slidingly move up along the respective sloped portions 220.

The contact portion 240, provided at the tip end of the second arm 212, is a projection projecting toward the one side in the third direction Z (upper side). When the tip end of the second arm 212 is received in the receiving groove 140, the contact portion 240 is positioned within the first depression 110 of the housing 100.

The tail 250 is continuously connected to the other side end in the second direction Y of the anchorable portion 210. When the anchorable portion 210 is press-fitted in the corresponding accommodating hole 130 of the housing 100, the tail 250 projects from the back face of the housing 100. The tail 250 is connectable by soldering with a signal electrode of the circuit board.

As illustrated in FIG. 3A and FIG. 3B, the pair of ground contacts 300 is electrically conductive metal plates in symmetrical shapes and is attachable to the housing 100. Each ground contact 300 includes a contact body 310, an abutting portion 320, connecting portions 331 and 332, and an engagement portion 340. The abutting portion 320 is a generally L-shaped plate having a first plate 321 and a second plate 322 that extend at right angles to each other. The first plate 321 is abuttable with the back face (outer face) of the housing 100, and the second plate 322 is engageable with the associated attachment depression 170 of the housing 100.

The engagement portion 340 is a plate extending from an end on one side in the third direction Z (upper end) toward the one side in the second direction Y of the first plate 321, i.e. extending substantially at right angles to the first plate 321. The engagement portion 340 is engageable with the associated engagement hole 160 of the housing 100. The contact body 310 is a plate extending from the end in the third direction Z (upper end) of the first plate 321 to the one side in the second direction Y. The contact body 310 includes a contact portion 311. The contact portion 311, or the tip end of the contact body 310, is folded back to the other side in the second direction Y and is of generally V-shape projecting to the other side in the third direction Z (lower side). The contact body 310 is to be received in the associated insertion hole 150 of the housing 100, so that the contact portion 311 may be positioned within the first depression 110 of the housing 100.

The connecting portion 331 is a plate extending from the other side end in the third direction Z (lower end) of the first plate 321 to the other side in the second direction Y, i.e. extending substantially at right angles to the first plate 321. The connecting portion 332 is a plate extending from the other side end in the third direction Z (lower end) of the second plate 322 to the outer side in the first direction X, i.e. extending substantially at right angles to the second plate 322. The connecting portions 331 and 332 are connectable by soldering to a ground electrode of the circuit board.

As illustrated in FIG. 2A to FIG. 3B, the actuator 400 is a plate made of an insulating resin to be held by the housing 100 so as to rotate between a lying position and an upright position. As illustrated in FIG. 2A to FIG. 2C, when the actuator 400 is in the lying position, its distal face (a distal face of a pressing portion 411 to be described) faces the one side in the second direction Y. As illustrated in FIG. 2D and FIG. 2E, when the actuator 400 is in the upright position, its distal face (the distal face of the pressing portion 411) faces the one side in the third direction Z (upward). The actuator 400 includes a main body 410, a pair of bosses 420, and the plurality of shafts 430.

Figure 2E:
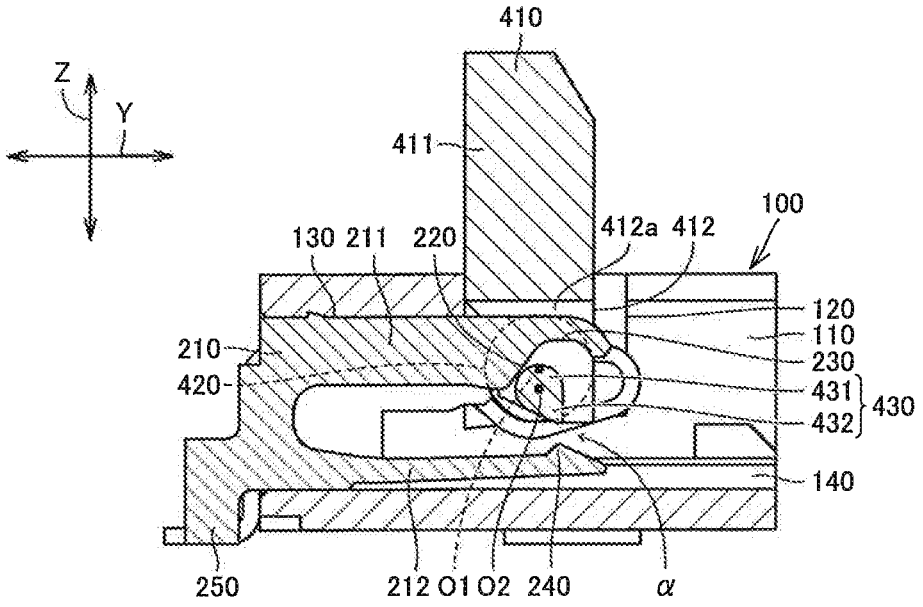
FIG. 2E is a cross-sectional view of the connector taken along line 2B-2B in FIG. 1A illustrating the actuator of the connector is positioned in the upright position.

The main body 410 includes the pressing portion 411, an elongated protrusion 412, and a pair of tabs 413. The pressing portion 411 is a generally rectangular plate extending in the first direction X (lengthwise direction). The pressing portion 411 includes a first end (end on a base end side) and a second end on a tip end side opposite of the base end side. The elongated protrusion 412 is provided in the middle of the first end of the pressing portion 411 so as to extend in the first direction X. The tabs 413 are provided at opposite ends in the first direction X of the first end of the pressing portion 411. The elongated protrusion 412 is positioned between the tabs 413. The elongated protrusion 412 and the tabs 413 are receivable in the first depression 110 of the housing 100. When the elongated protrusion 412 and the tabs 413 are received in the first depression 110 of the housing 100, there is a clearance between the actuator 400 (particularly the elongated protrusion 412 and the tabs 413) and the bottom of the first depression 110. The dimension in the third direction Z of the clearance is slightly smaller than the thickness dimension of the FPC 10. As illustrated in FIG. 2B and FIG. 2E, the clearance serves as an insertion slot α to press-fit the FPC 10.

The bosses 420 are cylindrical projections projecting in the first direction X from the respective tabs 413. The bosses 420 are to be received in the second depressions 120 of the housing 100 and roll from middle areas to upper areas of the slopes 121 of the second depressions 120. The rolling motion of the bosses 420 from the middle areas to the upper areas of the slopes 121 causes the actuator 400 to turn from the upright position to the lying position. When the actuator 400 is in the upright position as illustrated in FIG. 2E, the pressing portion 411 abuts the wall of the first depression 110 of the housing 100 on the other side in the second direction Y, while the bosses 420 are positioned in the middle areas of the respective slopes 121. When the actuator 400 turns into the lying position as illustrated in FIG. 2A, the bosses 420 moves upward of the slopes 121 and abuts both the slopes 121 and the walls 122 on the one side in the second direction Y of the second depressions 120. Further, when the actuator 400 is positioned in the lying position, the distance in the third direction Z between the pressing portion 411 and the bottom of the first depression 110 of the housing 100 is set to be slightly smaller than the thickness of the FPC 10. Accordingly, the pressing portion 411 is able to press the FPC 10 that is press-fitted in the insertion slot α.

As illustrated in FIG. 3A and FIG. 3B, the elongated protrusion 412 is provided with a plurality of slits 412*a* along the first direction X at the same intervals as the accommodating holes 130 of the housing 100. The slits 412*a* pass through the elongated protrusion 412 in the thicknesswise direction. The shafts 430 are provided between adjacent walls of the slits 412*a*, i.e. arranged at intervals (at the same intervals as the accommodating holes 130) along the first direction X to be located between the bosses 420 of the main body 410. The respective hooks 230 of the contacts 200 as positioned within the first depression 110 may be received in the upper sides of the slits 412*a*, i.e. on the one sides in the third direction Z of the shafts 430.

As illustrated in FIG. 2B and FIG. 2E, each shaft 430 is in a teardrop shape in sectional view that is smaller than each boss 420. Each shaft 430 includes a cylindrical portion 431 and a triangular prismatic portion 432 that are continuously connected to each other. The shafts 430 are provided such that their axial center O2 is shifted from the axial center O1 of the bosses 420 to a base end side of the main body 410. In other words, when the actuator 400 is in the upright position, the shafts 430 are located such that the axial center O2 is shifted from the axial center O1 of the bosses 420 toward the bottom of the first depression 110 of the housing 100. In accordance with the rotation of the bosses 420 to move upward from the middle areas of the slopes 121, the shafts 430 rotate and move toward the one side in the third direction.

Particularly, as illustrated in FIG. 2E, when the bosses 420 are positioned in the middle areas of the slopes 121, the shafts 430 abut associated lower areas of the sloped portions 220 of the contacts 200 to be positioned on the other sides in the third direction Z of (below) the hooks 230 of the contact 200. In this state, there is some clearance between the shafts 430 and the hooks 230. Specifically, the cylindrical portions 431 abut the lower areas of the sloped portions 220, while the triangular prismatic portions 432 are directed obliquely right downward in FIG. 2E (oriented between the one side in the second direction Y and the other side in the third direction Z). When the bosses 420 are positioned in the upper areas of the slopes 121, the shafts 430 abut associated upper areas of the sloped portions 220 of the contacts 200 to be engaged with the hooks 230 of the contacts 200. Specifically, the cylindrical portions 431 are engaged with the hooks 230, while the triangular prismatic portions 432 abut against the sloped portions 220 to be directed obliquely left downward in FIG. 2E (oriented between the other side in the second direction Y and the other side in the third direction Z). In this manner, the shafts 430 are movable from the other sides in the third direction Z of the hooks 230 (e.g., below the hooks 230) to positions to allow the engagement of the shafts 430 with the hooks 230. The triangular prismatic portions 432 are rotatable from the positions directed obliquely right downward in FIG. 2E to the position directed obliquely left downward in FIG. 2E. When the shafts 430 move from the other sides in the third direction Z of the hooks 230 to the positions for engagement with the hooks 230, the shafts 430 slidingly move up along the sloped portions 220, i.e. from the lower areas to the upper areas of the sloped portions 220. It should be noted that the abutment of the triangular prismatic portions 432 with the sloped portions 220 lessens the possibility of the actuator 400 turning further toward the other side in the third direction Z beyond the lying position.

The following paragraphs describe exemplary steps of assembling the connector described above with reference to FIG. 4A and FIG. 4B. The first step is to prepare the housing 100 by injection-molding an insulating resin. Also prepared are the ground contacts 300 by press-molding metal plates having electrical conductivity. Then, the contact bodies 310 of the ground contacts 300 are inserted into the respective insertion holes 150 of the housing 100, and the engagement portions 340 of the ground contacts 300 are fitted into (engaged with) the respective engagement holes 160 of the housing 100. This causes the contact portions 311 of the contact bodies 310 to be positioned within the first depression 110 of the housing 100, the first plates 321 to abut the back face of the housing 100, and the second plates 322 to be fitted into (engaged with) the attachment depressions 170 of the housing 100. In this manner, the ground contacts 300 are attached to the housing 100. Alternatively, the ground contacts 300 may be attached after the actuator 400 is attached to the housing 100, as will be described below.

Figure 4A:
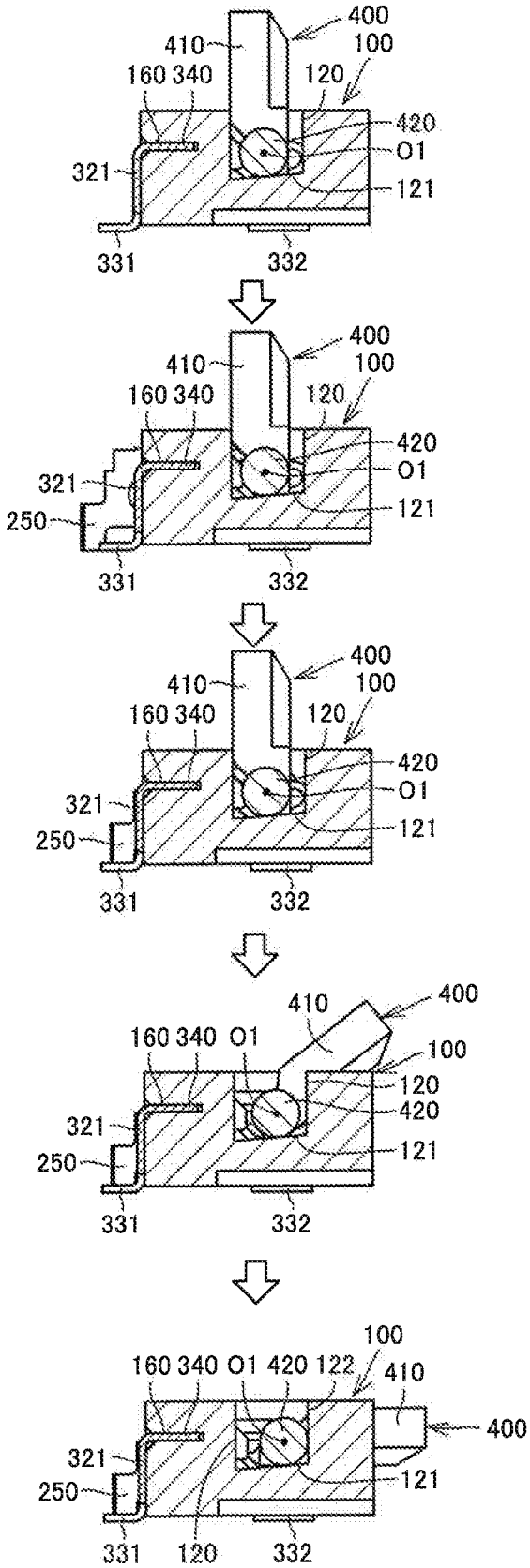
FIG. 4A shows cross-sectional views of the connector taken along line 2A-2A in FIG. 1A illustrating assembly steps of the connector and a rotation process of the actuator.
Figure 4B:
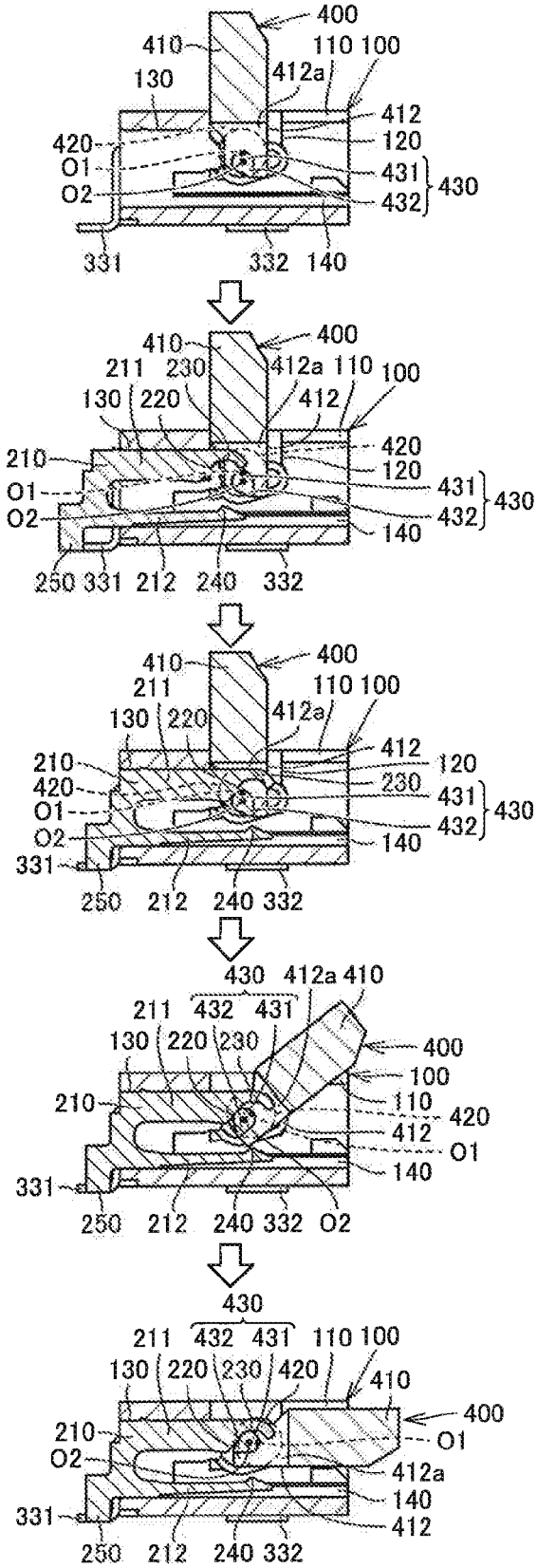
FIG. 4B shows cross-sectional views of the connector taken along line 2B-2B in FIG. 1A illustrating the assembly steps of the connector and the rotation process of the actuator.

Thereafter, the actuator 400 is prepared by injection-molding an insulating resin. As illustrated in FIG. 4A and FIG. 4B, the elongated protrusion 412 and the tabs 413 of the actuator 400 are inserted into the first depression 110 of the housing 100 from the one side in the third direction Z, while the bosses 420 are inserted into the second depressions 120 of the housing 100 from the one side in the third direction Z. This insertion causes the pressing portion 411 to abut the wall in the other side in the second direction Y of the first depression 110, and the bosses 420 to be positioned in the middle areas of the slopes 121 of the second depressions 120. As a result, the actuator 400 is placed in the upright position.

Thereafter, the contacts 200 are prepared by pressing metal plates having electrical conductivity. Then, the contacts 200 are press-fitted into the respective accommodating holes 130 of the housing 100. This causes the tip ends of the first arms 211, the sloped portions 220, and the hooks 230 of the contacts 200 to be received in the first depression 110 of the housing 100, and the tip ends of the second arms 212 to be received in the corresponding receiving grooves 140. Simultaneously, the hooks 230 of the contacts 200 are inserted into the respective slits 412*a* in the elongated protrusion 412 of the actuator 400 positioned within the first depression 110, and the sloped portions 220 are brought into abutment with the shafts 430 positioned within the first depression 110. As a result, the shafts 430 abut the lower areas of the sloped portions 220 to be positioned below the hooks 230.

Before the connector assembled in the above steps is mounted onto a circuit board, the actuator 400 is turned from the upright position to the lying position. This causes the bosses 420 to rotatingly move up from the middle areas to the upper areas of the slopes 121 of the second depressions 120. Accordingly, the shafts 430 slidingly move from the lower areas to the upper areas of the sloped portions 220 (move upward from below the hooks 230) so as to be engaged with the hooks 230. Simultaneously, the triangular prismatic portions 432 rotate toward the sloped portions 220. Once the actuator 400 is placed in the lying position, the triangular prismatic portions 432 of the shafts 430 abut the sloped portions 220, thereby restricting the movement of the actuator 400 so as not to turn further toward the other side in the third direction Z beyond the lying position. On the other hand, the bosses 420 abut the slopes 121 and the walls 122 of the second depressions 120, and the shafts 430 are engaged with the hooks 230 from the other side in the third direction Z to abut the sloped portions 220. These abutments restrict the actuator 400 to move in four directions, namely to the one and other sides in the second direction Y and the one and other sides in the third direction Z.

Now the connector is ready to be mounted onto a circuit board in the following exemplary steps. First, the circuit board is prepared. Onto a ground electrode of the circuit board, the connecting portions 331 and 332 of the ground contacts 300 of the connector are placed. This causes the tails 250 of the contacts 200 to be placed on associated signal electrodes of the circuit board. Thereafter, the connecting portions 331 and 332 are soldered to the ground electrodes, and the tails 250 are soldered to the signal electrodes.

Figure 5A:
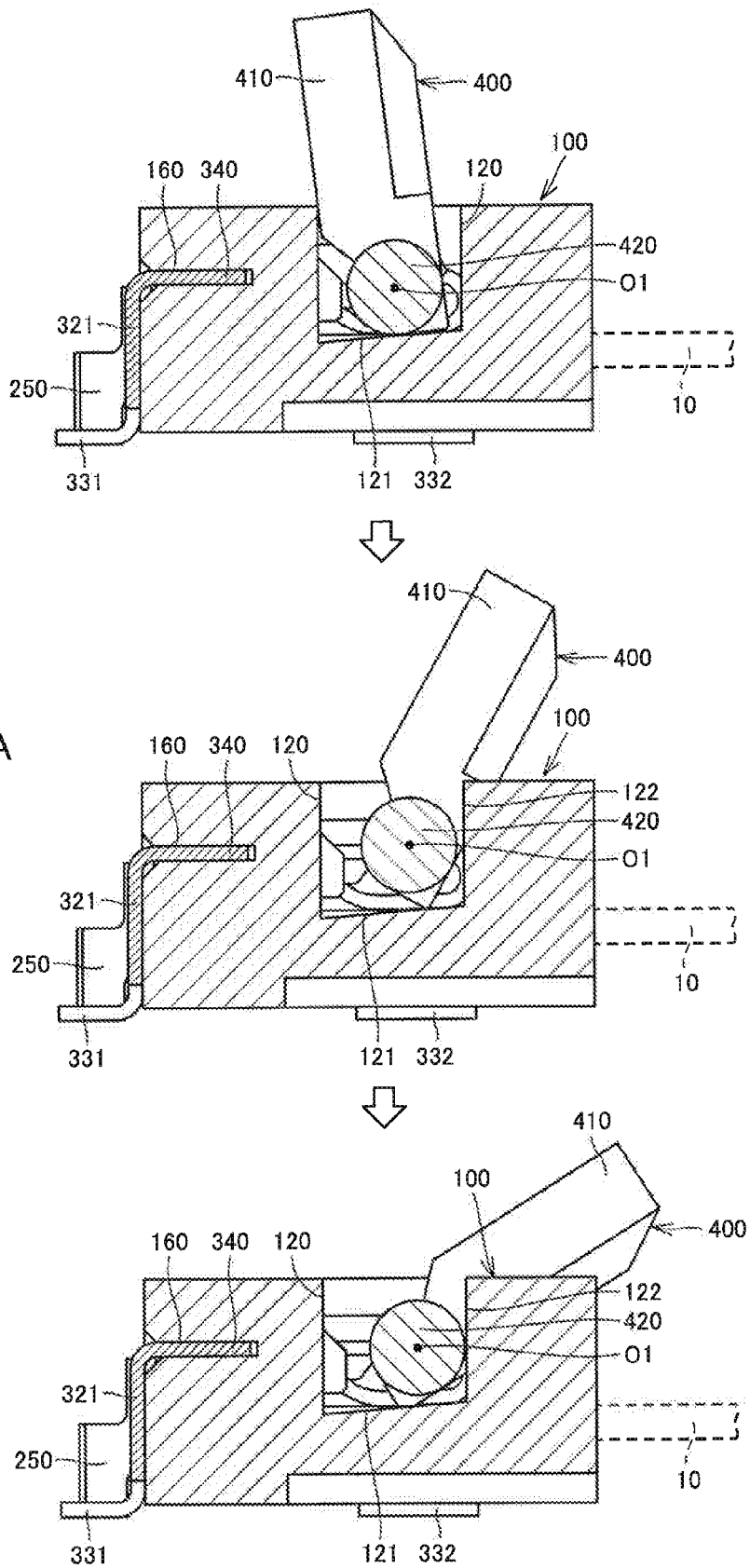
FIG. 5A shows cross-sectional views of the connector taken along line 2A-2A in FIG. 1A illustrating a process of connecting an FPC with the connector.
Figure 5B:
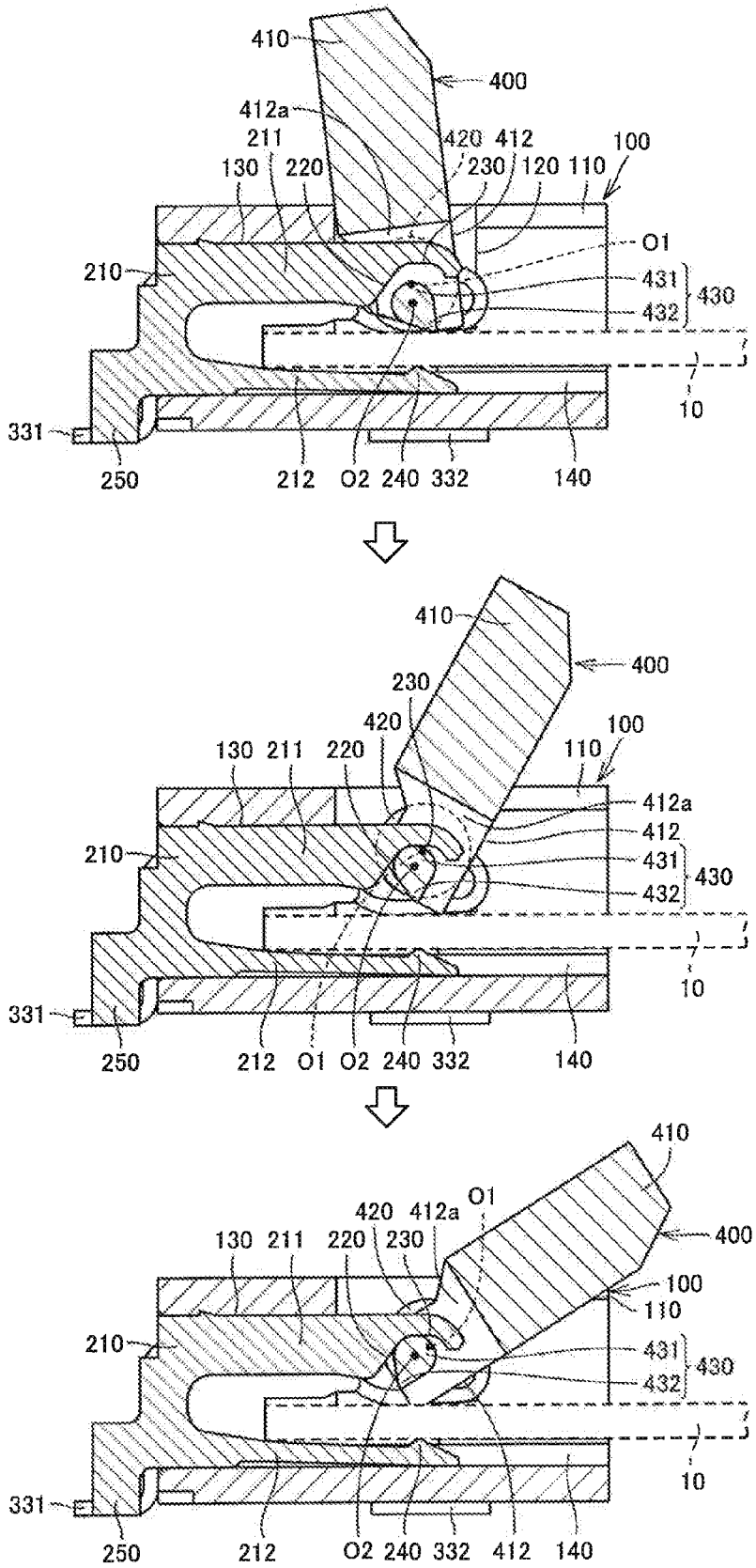
FIG. 5B shows cross-sectional views of the connector taken along line 2B-2B in FIG. 1A illustrating the process of connecting the FPC with the connector.

The following paragraphs describe exemplary steps of connecting the FPC 10 to the connector mounted on the circuit board with reference to FIG. 5A to FIG. 6C. First, the actuator 400 is placed in the upright position. In this state the FPC 10 is press-fitted into the insertion slot $\alpha$ of the connector as illustrated in FIG. 5A and FIG. 5B. This causes the contact portions 240 of the contacts 200 to be brought into elastic contact with conducting lines (not shown) formed on a lower surface of the FPC 10, and the contact portions 311 of the ground contacts 300 to be brought into elastic contact with a ground (not shown) on an upper surface of the FPC 10 (see FIG. 6C). Simultaneously, the elongated protrusion 412 and the tabs 413 of the actuator 400 are pressed against the FPC 10, the shafts 430 are positioned away from the sloped portions 220 of the contacts 200 and right under the hooks 230 (on the other side in the third direction Z of the hooks 230) (see the upper view of FIG. 5B).

Thereafter, the actuator 400 is turned from the upright position to the lying position. This causes corners on the one side in the second direction Y of the elongated protrusion 412 and the tabs 413 of the actuator 400 to abut the FPC 10, and the actuator 400 turns with the corners serving as the fulcrum. Accordingly, the bosses 420 are rotatingly lifted upward from the slopes 121 of the second depressions 120 (see the middle view of FIG. 5A). Along with this, the shafts 430 are rotatingly moved upward (move to the one side in the third direction Z) so as to be engaged with the hooks 230 (see the middle view of FIG. 5B). Then, the bosses 420 rotate and abut the walls 122 on the one side in the second direction Y of the second depressions 120 (see the bottom view of FIG. 5A). Simultaneously, the shafts 430 rotate while being engaged with the hooks 230 (see the bottom view of FIG. 5B). The triangular prismatic portions 432 of the shafts 430 rotate toward the associated sloped portions 220.

Figure 6A:
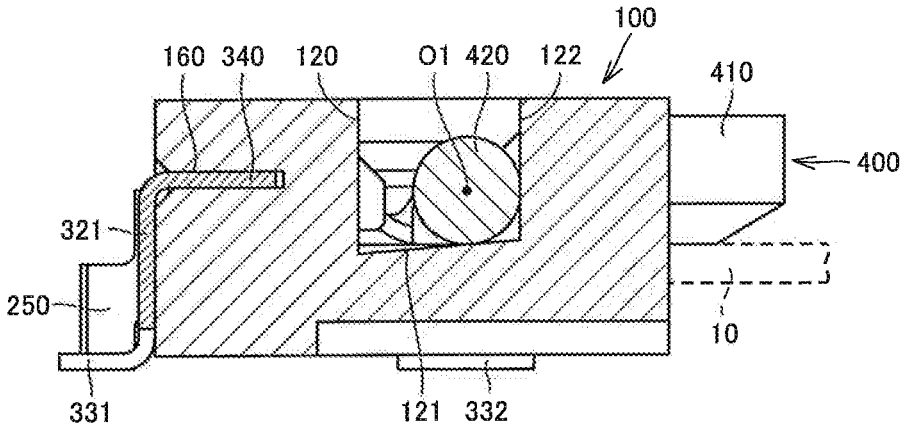
FIG. 6A shows a cross-sectional view of the connector with the FPC connected, taken along line 2A-2A in FIG. 1A.
Figure 6B:
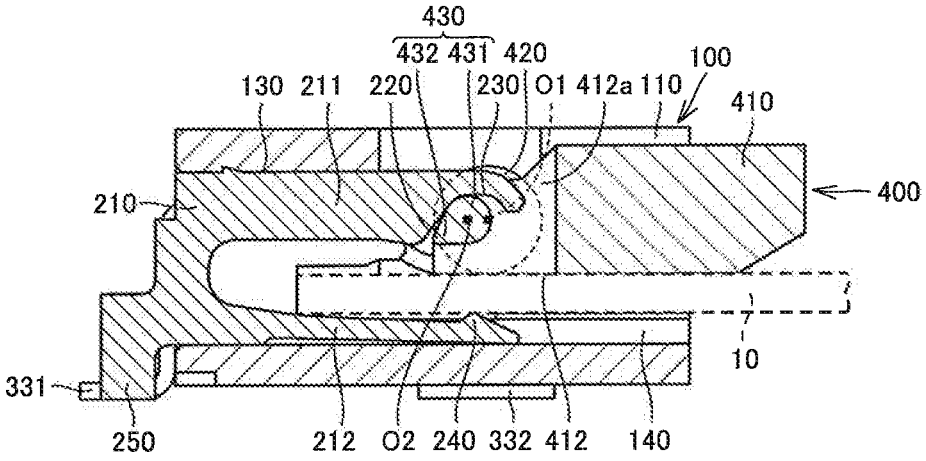
FIG. 6B shows a cross-sectional view of the connector with the FPC connected, the connector taken along line 2B-2B in FIG. 1A.
Figure 6C:
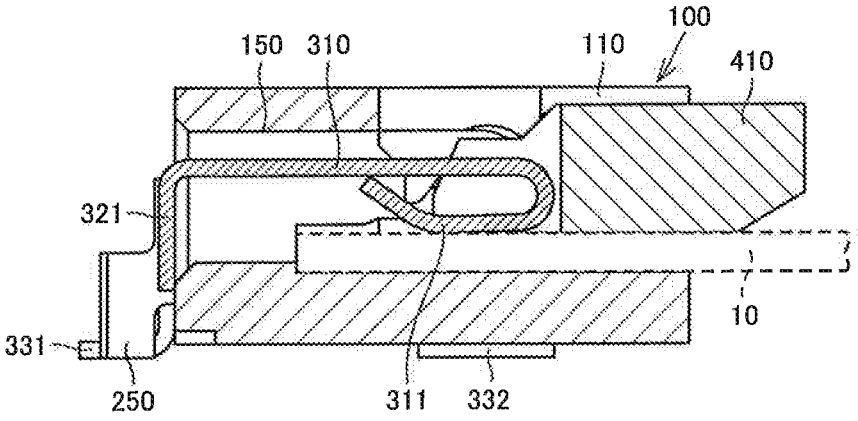
FIG. 6C shows a cross-sectional view of the connector with the FPC connected, taken along line 2C-2C in FIG. 1A.

Once the actuator 400 is placed in the lying position as illustrated in FIG. 6A, the bosses 420 abut the walls 122 on the one side in the second direction Y of the second depressions 120 so as to be positioned on upper areas of the slopes 121 of the second depressions 120. This positional relationship enables the restriction of the actuator 400 to move to the one side in the second direction Y and the other side in the third direction Z. Further, as illustrated in FIG. 6B, the shafts 430 are engaged with the hooks 230 and abut the sloped portions 220. This positional relationship enables the restriction of the actuator 400 to move to the one side in the third direction Z and the other side in the second direction Y. In addition, as the triangular prismatic portions 432 of the shafts 430 abut the sloped portions 220, the movement of the actuator 400 is restricted so as not to turn further to the other side in the third direction Z beyond the lying position. Also, the actuator 400 in the lying position presses the FPC 10 with its pressing portion 411 to the other side in the third direction Z so as to bring the signal electrodes of the FPC 10 into elastic contact with the contact portions 240 of the contacts 200.

The connector as described above has a number of advantageous features. First, when the actuator 400 is in the upright position, the bosses 420 are positioned on the slopes 121 of the second depressions 120 of the housing 100, while the shafts 430 are positioned on the other side in the third direction Z of the hooks 230 of the contacts 200. Accordingly, with the actuator 400 in the upright position, the hooks 230 and the sloped portions 220 do not press the shafts 430 during the insertion of the contacts 200 into the accommodating holes 130 of the housing 100. Further, when the actuator 400 is turned from the upright position to the lying position, the bosses 420 rotatingly move up along the slopes 121 of the second depressions 120, while the shafts 430 move from the other side in the third direction Z of the hooks 230 to the one side in the third direction Z so as to be engaged with the hooks 230. At this time, the shafts 430 of the actuator 400 only slide along the sloped portions 220 of the contacts 200. Therefore, the connector can reduce a load placed on the hooks 230 of the contacts 200 and the shafts 430 of the actuator 400 when attaching the contacts 200 into the housing 100 and when engaging the shafts 430 of the actuator 400 with the hooks 230 of the contacts 200.

Further advantageously, when the actuator 400 is in the upright position, the shafts 430 are positioned such that their axial center O2 is shifted from the axial center O1 of the bosses 420 toward the bottom side of the first depression 110 of the housing 100. This configuration can increase the moving distance of the shaft 430 to the one direction in the third direction when the actuator 400 turns from the upright position to the lying position and when the bosses 420 rotatingly move up along the slopes 121 of the second depressions 120. The increased moving distance enables it to displace the shafts 430 of the actuator 400 in the upright position to a large degree away from the hooks 230 to the other side in the third direction Z. Therefore, it is possible to prevent the hooks 230 of the contacts 200 from colliding with the shafts 430 of the actuator 400 during the insertion of the contacts 200 into the accommodating holes 130, thereby lessening the possibility of placing load on the contacts 200 and the actuator 400.

Further, the shafts 430 move up along the sloped portions 220 when the bosses 420 move up along the slopes 121 of the second depressions 120. This configuration makes it possible to lessen the possibility of the bosses 420 slipping on the slopes 121 of the second depressions 120 or moving to the other side in the second direction Y.

In addition, when the actuator 400 is in the lying position, the bosses 420 abut the slopes 121 and the walls 122 of the second depressions 120, while the shafts 430 are engaged with the hooks 230 from the one side in the third direction Z and abut the sloped portions 220. This positional relationship can restrict the movement of the actuator 400 in four directions, namely to the one and other sides in the second direction Y and the one and other sides in the third direction Z. Therefore, the actuator 400 in the lying position is less likely to fall off from the housing 100. Consequently, the connector is easy to mount onto the circuit board and carry with the actuator 400 in the lying position.

Further advantageously, the ground contact 300 are configured such that the connecting portions 331 and 332 are to be connected by soldering to the ground electrode of the circuit board and the contact portion 311 are to be connected to the ground of the FPC 10 for shielding the connector. This configuration makes it possible to improve the connector in terms of EMI characteristics or the like. In addition, the first and second plates 321 and 322 of the generally L-shaped abutting portions 320 of the ground contacts 300 are provided with the connecting portions 331 and 332, respectively. By soldering the connecting portions 331 and 332 to the ground electrode of the circuit board, the connector has an improved mounting strength with respect to the circuit board.

It should be noted that the connector of the invention is not limited to the exemplary connector according to the above embodiment 1 and may be modified in design within the scope of claims of the invention. Specific modifications will be described in detail below.

The housing 100 according to Embodiment 1 includes the first depression 110, the second depressions 120, the accommodating holes 130, the receiving grooves 140, the insertion holes 150, the engagement holes 160, and the attachment depressions 170. However, the housing of the invention may be modified, only requiring the first depression and the pair of second depressions provided in the opposite edges in the first direction of the first depression.

The contacts 200 according to Embodiment 1 are press-fitted in the accommodating holes 130 of the housing 100. However, the contacts of the invention may be modified, only requiring that they are disposed at intervals along the first direction within the housing. For example, the contacts may be embedded in the housing by insert molding. In this case, one possible modification is such that the second depressions 120 are open to the one side in the second direction Y to receive the bosses 420 of the actuator 400 from the one side in the second direction Y.

The contacts 200 according to Embodiment 1 each include the anchorable portion 210, the sloped portion 220, the hook 230, the contact portion 240, and the tail 250. However, the contacts of the invention may be modified, only requiring hooks to be disposed within the first depression of the housing. Specifically, the contacts may be pivoting contacts provided with hooks for engagement with the shafts of the actuator in the lying position. In this case, the modified connector may be configured to be provided with an additional contact for connection with a connecting object such as an FPC.

The actuator 400 according to Embodiment 1 is provided with the main body 410, the pair of bosses 420, and the plurality of shafts 430, where the main body 410 includes the pressing portion 411, the elongated protrusion 412, and the pair of tabs 413, the bosses 420 are provided on the tabs 413, and the shafts 430 are provided in the elongated protrusion 412. However, the actuator of the invention may be modified, only requiring the main body, the pair of bosses as projections on opposite ends in the first direction of the main body to be received in the second depressions of the housing, and the shafts provided between the bosses of the main body to be received in the first depression of the housing and engageable with the respective hooks of the contacts. Also, the actuator is only required to be held by the housing so as to rotate between the upright position and the lying position. In other words, the actuator may be held by the housing and another element member (contacts, for example) so as to rotate between the upright position and the lying position.

With regard to the relative positions of the bosses 420 and the shafts 430 with respect to the actuator 400 in the upright position in Embodiment 1, the bosses 420 are positioned in the middle areas of the slopes 121 of the second depressions 120 of the housing 100, and the shafts 430 abut the lower areas of the sloped portions 220 of the contacts 200 to be positioned below the hooks 230. However, the relative positions of the bosses and the shafts with respect to the actuator in the upright position may be modified, only required that the bosses are positioned on the slopes of the second depressions of the housing, while the shafts are positioned on the other side in the third direction of the hooks of the contacts with some clearance from the hook. For example, it is possible to omit the sloped portions of the contacts, in which case the shafts may be positioned on the other side in the third direction of the hooks of the contacts when the actuator is in the upright position. In other words, the contacts may not be involved in the turning of the actuator, and their hooks may be engaged with the shafts of the actuator in the lying position only. In case where the contacts are pivoting contacts as described above, the contacts may be or may not be provided with the sloped portions.

With regard to the movements of the bosses 420 and the shafts 430 in relation to the actuator 400 turning from the upright position to the lying position in Embodiment 1, the bosses 420 rotatingly move from the middle areas to the upper areas of the slopes 121, and the shafts 430 rotatingly slide from the lower areas to the upper areas of the sloped portions 220 (move upward from under the hooks 230) to be engaged with the hooks 230. However, the movements of the bosses and the shafts in relation to the actuator turning from the upright position to the lying position may be different. The movements only require that the bosses rotatingly move up along the slopes of the second depressions of the housing, and the shafts move to the one side in the third direction to be engaged with the hooks of the contacts. Accordingly, the shafts may not slide along the sloped portions of the contacts when the actuator turns from the upright position to the lying position.

With regard to the relative positions of the bosses 420 and the shafts 430 with respect to the actuator 400 in the lying position in Embodiment 1, the bosses 420 abut the slopes 121 and the walls 122 of the second depressions 120, and the shafts 430 are engaged with the hooks 230 from the one side in the third direction Z and abut the sloped portions 220. The relative positions of the bosses and the shafts with respect to the actuator in the lying position may be modified, only requiring that the shafts are engaged with the hooks.

The bosses 420 according to Embodiment 1 are cylindrical projections projecting in the first direction X from the tabs 413 of the actuator. However, the bosses may be any other projections provided at the opposite ends in the first direction of the main body of the actuator to be received in the second depressions. Further, the bosses are not necessarily be cylindrical in shape and may be projections of any other shapes that can rotatingly move up along the slopes of the second depressions. For example, the bosses may be of polygonal column shape.

The shafts 430 according to Embodiment 1 are provided between the respective walls of the slit 412*a* of the elongated protrusion 412. However, the shafts of the invention may be modified, only required to be provided between the bosses of the main body of the actuator and received in the first depression for engagement with the respective hooks of the contacts. For example, a single shaft may provided between the bosses of the main body for engagement with a plurality of hooks of the contacts. Alternatively, the shafts may be provided between the walls of the slits in the base end of the main body of the actuator for engagement with the plurality of hook of the contacts.

The actuator of the invention is not limited to the configuration according to Embodiment 1, i.e. when the actuator 400 is positioned in the upright position, the shafts 430 are disposed such that their axial center O2 is shifted from the axial center O1 of the bosses 420 toward the bottom side of the first depression 110 of the housing 100. For example, the axial center of the shafts may be identical with the axial center of the bosses. Further, the shape of the shafts is not limited to a teardrop shape and may be of cylindrical, polygonal column, or the like shape.

The connector of the invention may be provided with the ground contacts 300 according to Embodiment 1. The connector may not be provided with ground contacts. The ground contacts of the invention may be modified, only required to each include the contact body to be disposed in the housing and the contact portion to be disposed within the first depression of the housing. For example, the ground contacts may be embedded in the housing by insert molding. Further, the ground contacts may be formed without the abutting portions and/or the connecting portions.

It should be noted that the materials, the shapes, the dimensions, the numbers, and the arrangements of the components of the connector according to Embodiment 1 is described above by way of example only. The connector may be modified in any manner as long as it can perform the same or similar functions. Further, the connector according to Embodiment 1 is adapted for connection with the FPC 10 as the connecting object. However, the invention is applicable for connection with any other flat connecting objects such as a flexible flat cable (FFC) and a flat cable of other kind. It should be noted the upright position herein is defined as any position where the actuator faces to the one side in the third direction. The lying position herein is defined as any position where the actuator faces to the one side in the second direction.

REFERENCE SIGNS LIST

100 Housing
- 110 First Depression
- 120 Second Depression
  - 121 Slope
  - 122 Wall
- 130 Accommodating hole
- 140 Receiving Groove
- 150 Insertion Hole
- 160 Engagement Hole
- 170 Attachment Depression

200 Contact
- 210 Anchorable portion
- 220 Sloped portion
- 230 Hook
- 240 Contact portion
- 250 Tail

300 Ground Contact
- 310 Contact body
  - 311 Contact portion
- 320 Abutting portion
  - 321 First Plate

322 Second Plate
331 Connecting Portion
332 Connecting Portion
340 Engagement Portion
400 Actuator
410 Main Body
420 Boss
430 Shaft
431 Cylindrical portion
432 Triangular prismatic portion
O1 Axial center of Boss
O2 Axial center of Shaft
X First Direction
Y Second Direction
Z Third Direction

The invention claimed is:

1. A connector comprising:

a housing having an insulation property, the housing including:

a first depression; and a pair of second depressions provided at opposite edges in a first direction of the first depression, the second depressions each including a bottom surface forming a slope, the slope sloping up toward the one side in a second direction orthogonally intersecting with the first direction;

a plurality of contacts arranged at intervals along the first direction in the housing, the contacts each including a hook to be disposed within the first depression; and an actuator to be held at least by the housing so as to rotate between a lying position and an upright position, the actuator in the lying position facing to one side in the second direction, the actuator in the upright position facing one side in a third direction orthogonally intersecting with the first and the second directions, the actuator including:

a main body;

a pair of bosses projecting from respective opposite ends in the first direction of the main body to be received in the respective second depressions; and a shaft located between the bosses of the main body to be received in the first depression, wherein when the actuator is in the upright position, the bosses are on the associated slopes of the second depressions, and the shaft is positioned on the other side in the third direction of the hooks, and when the actuator rotates from the upright position to the lying position, the bosses rotatingly move up along the slopes of the second depressions, and the shaft thereby move to the one side in the third direction to be engaged with the hooks.

2. The connector according to claim 1, wherein the housing further includes a plurality of accommodating holes that are arranged at intervals along the first direction and communicate with the first depression, the contacts are received and held in the respective accommodating holes.

3. The connector according to claim 2, wherein the shaft of the actuator in the upright position is disposed such that an axial center of the shaft is shifted away from an axial center of the bosses toward a bottom of the first depression of the housing.

4. The connector according to claim 1, further comprising:

a ground contact provided in the housing, the ground contact including a contact portion disposed within the first depression.

5. The connector according to claim 4, wherein the ground contact includes:

a contact body including the contact portion;

an abutting portion continuously connected to the contact body and abutting an outer surface of the housing; and a connecting portion provided at the abutting portion.

6. The connector according to claim 5, wherein the abutting portion is generally of an L shape including:

a first plate; and a second plate extending substantially at a right angle to the first plate; wherein the first and the second plates are each provided with the connecting portion.

7. The connector according to claim 1, wherein the contacts each further include an sloped portion provided on the other side in the second direction of the hook, the sloped portion including a portion on the other side in the third direction that slopes up to the one side in the second direction, the shaft of the actuator in the upright position abuts the sloped portion, and when the bosses rotatingly move up along the slopes of the second depressions, the shaft moves up along the sloped portions to be engaged with the hooks.

8. The connector according to claim 7, wherein the second depressions each further include a wall on the one side in the second direction, and the bosses of the actuator in the lying position abut the slopes and the walls of the second depressions, while the shaft is engaged with the hooks and abut the sloped portions.

9. The connector according to claim 7, wherein the shaft is configured in a teardrop shape including:

a cylindrical portion; and a triangular prismatic portion continuously connected to the cylindrical portion, when the actuator is in the upright position, the cylindrical portion of the shaft abuts lower areas of the sloped portions, while the triangular prismatic portion of the shaft is directed to the other side in the third direction, when the bosses rotatingly move up along the slopes of the second depressions, the cylindrical portion moves up along the sloped portions to be engaged with the hooks, while the triangular prismatic portion rotates toward the sloped portions, and when the cylindrical portion is engaged with the hooks, the triangular prismatic portion abuts the sloped portions.

10. The connector according to claim 7, wherein the housing further includes a plurality of accommodating holes that are arranged at intervals along the first direction and communicate with the first depression, the contacts are received and held in the respective accommodating holes.

11. The connector according to claim 10, wherein the shaft of the actuator in the upright position is disposed such that an axial center of the shaft is shifted away from an axial center of the bosses toward a bottom of the first depression of the housing.

* * * * *